US008739726B2

(12) United States Patent
Mann et al.

(10) Patent No.: US 8,739,726 B2
(45) Date of Patent: Jun. 3, 2014

(54) DOCK SYSTEM INCLUDING COLLAPSIBLE FRAME, AND METHOD FOR ASSEMBLING DOCK SYSTEM INCLUDING COLLAPSIBLE FRAME

(75) Inventors: Anthony Boyce Mann, Brunswick, GA (US); Mark Douglas Johnson, Wilmington, NC (US); Tony Shelby Garrett, Jr., Wilmington, NC (US)

(73) Assignee: Bellingham Marine Industries, Inc., Bellingham, WA (US)

( * ) Notice: Subject to any disclaimer, the term of this patent is extended or adjusted under 35 U.S.C. 154(b) by 77 days.

(21) Appl. No.: 13/397,382

(22) Filed: Feb. 15, 2012

(65) Prior Publication Data

US 2012/0204779 A1 Aug. 16, 2012

Related U.S. Application Data

(60) Provisional application No. 61/443,046, filed on Feb. 15, 2011.

(51) Int. Cl.
*B63B 35/44* (2006.01)

(52) U.S. Cl.
USPC ..... 114/263; 114/266

(58) Field of Classification Search
USPC ..... 114/263, 266
See application file for complete search history.

(56) References Cited

U.S. PATENT DOCUMENTS

| | | | | | |
|---|---|---|---|---|---|
| 3,289,621 | A * | 12/1966 | Sebring | 114/266 |
| 4,223,629 | A * | 9/1980 | Dunlop | 114/263 |
| 4,562,786 | A * | 1/1986 | Pruonto | 114/61.22 |
| 4,655,156 | A * | 4/1987 | Svirklys et al. | 114/266 |
| 4,675,942 | A * | 6/1987 | Julien, Jr. | 16/384 |
| 4,887,654 | A * | 12/1989 | Rytand | 114/267 |
| 5,664,513 | A * | 9/1997 | Echelbarger | 114/45 |
| 5,845,594 | A * | 12/1998 | Hallsten et al. | 114/263 |
| 6,217,259 | B1 * | 4/2001 | Godbersen | 405/218 |
| 7,000,558 | B2 * | 2/2006 | Johnson | 114/266 |
| 7,241,078 | B2 * | 7/2007 | Surges | 405/220 |
| 7,273,018 | B2 * | 9/2007 | Strong | 114/266 |
| 7,325,276 | B2 * | 2/2008 | Kim | 16/262 |
| 7,454,811 | B1 * | 11/2008 | Stotka | 14/69.5 |
| 7,455,026 | B2 * | 11/2008 | Towley et al. | 114/344 |
| 7,845,300 | B1 * | 12/2010 | Stroud | 114/263 |
| 7,861,379 | B2 * | 1/2011 | Peters et al. | 16/375 |
| 7,895,713 | B2 * | 3/2011 | Williams, Jr. | 16/387 |
| 7,945,995 | B1 * | 5/2011 | Gates | 16/226 |
| 8,091,500 | B2 * | 1/2012 | Stroud | 114/263 |
| 2002/0121795 | A1 * | 9/2002 | Murray | 296/76 |
| 2012/0204779 | A1 * | 8/2012 | Mann et al. | 114/263 |

* cited by examiner

*Primary Examiner* — Lars A Olson
*Assistant Examiner* — Jovon Hayes
(74) *Attorney, Agent, or Firm* — Seed IP Law Group PLLC

(57) ABSTRACT

A dock system including a collapsible frame, and method for assembling the dock system including collapsible frame are provided. A collapsible dock system includes a collapsible frame. The collapsible frame includes a first beam, a second beam, a cross-member, and a hinged bracket system. The cross-member system secures the first beam to the second beam. The hinged bracket system is selectively coupled to the first beam and the second beam in either a compact transport state in which the first beam is movable relative to the second beam or a fixed installation state in which the first beam is fixed relative to the second beam.

16 Claims, 9 Drawing Sheets

DOCK SYSTEM INCLUDING COLLAPSIBLE FRAME, AND METHOD FOR ASSEMBLING DOCK SYSTEM INCLUDING COLLAPSIBLE FRAME

CROSS-REFERENCE TO RELATED APPLICATION

This application claims the benefit under 35 U.S.C. §119 (e) of U.S. Provisional Patent Application No. 61/443,046 filed Feb. 15, 2011, the contents of which are incorporated herein by reference in their entirety.

BACKGROUND

1. Field

This disclosure generally relates to docks, and methods for manufacturing, shipping, assembling, and/or installing docks.

2. Description of the Related Art

Marina docks or piers are typically assembled at the location where they will be installed. This requires that all of the materials used to assemble the dock be delivered to the installation site prior to construction. To the extent that materials suppliers are not located near the installation site, shipping costs, shipment timing, and other supply chain obstacles can be issues for both the installer of the dock and the customer. In addition, assembly and installation of docks can be difficult, particularly for large docks or unusually shaped docks. Further, assembly and installation can be challenging for inexperienced workers.

BRIEF SUMMARY

In one aspect, a collapsible frame for a dock system is provided. The collapsible frame includes a first beam, a first cross-member, and a first hinged bracket that selectively secures the first beam to the first cross-member in either a first collapsible state in which the first cross-member is rotatable relative to the beam or a first expanded state in which the first cross-member is fixed relative to the beam.

In another aspect a collapsible dock system includes a collapsible frame. The collapsible frame includes a first beam, a second beam, a cross-member, and a hinged bracket system. The cross-member system secures the first beam to the second beam. The hinged bracket system is selectively coupled to the first beam and the second beam in either a compact transport state in which the first beam is movable relative to the second beam or a fixed installation state in which the first beam is fixed relative to the second beam.

In another aspect a method for assembling a dock is provided. The method includes unfolding a pre-assembled frame, locking the preassembled frame in a rigid configuration, securing a plurality of floats to first side of the preassembled frame, and securing a decking surface to a second side, opposite the first side, of the preassembled frame.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE INVENTION

In the following description, certain specific details are set forth in order to provide a thorough understanding of various embodiments of the invention. However, one skilled in the art will understand that the invention may be practiced without these details.

Unless the context requires otherwise, throughout the specification and claims which follow, the word "comprise" and variations thereof, such as, "comprises" and "comprising" are to be construed in an open, inclusive sense, that is as "including, but not limited to."

For the purposes of this disclosure, unless otherwise indicated, all numbers used in the specification are to be understood as being modified in all instances by the term "about." Accordingly, unless indicated to the contrary, the numerical parameters set forth in the following specification are approximations that can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the present disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a stated range of "1 to 10" should be considered to include any and all sub-ranges between (and inclusive of) the minimum value of 1 and the maximum value of 10; that is, all sub-ranges beginning with a minimum value of 1 or more, e.g. 1 to 6.1, and ending with a maximum value of 10 or less, e.g., 5.5 to 10.

The headings provided herein are for convenience only and do not interpret the scope of meaning of the claimed invention.

I. Overview

Marinas employ floating piers or docks as locations to park, tie up, or store boats. Conventional docks have historically been constructed at an installation site at the marina. This requires the raw materials for the dock to be shipped unassembled to the marina, and then assembled by a team of workers. Construction is expensive because it requires a large team of workers, and the components may be shipped from lumber yards that do not specialize in the size and type of lumber required to construct the dock.

Figure 1:
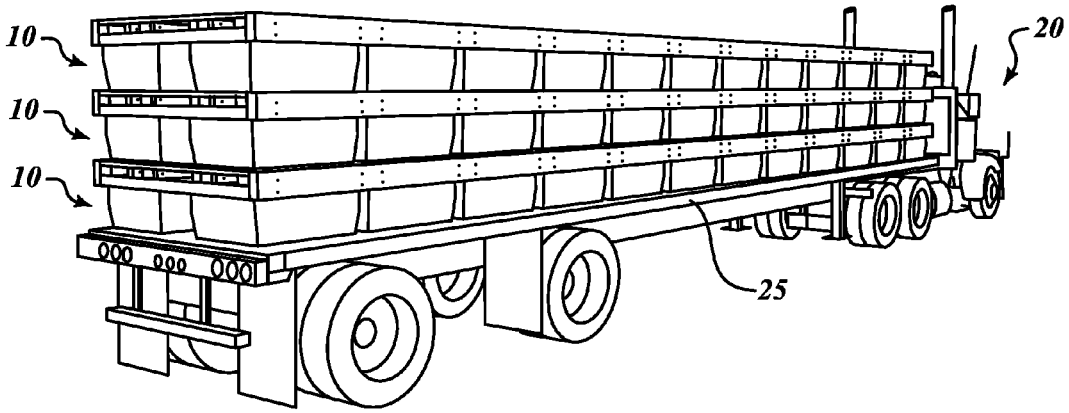
FIG. 1 is a pictorial view of a flatbed truck including several conventional pre-assembled docks.

In order to save on the time and expense associated with extensive on-site assembly, it is possible to ship a plurality of pre-assembled docks to an installation site. For example, FIG. 1 illustrates a plurality of pre-assembled docks 10 loaded onto a flatbed trailer 25 of a truck 20. However, as shown in FIG. 1, only a few pre-assembled docks 10 can be loaded onto a single flat-bed trailer 25.

Figure 2A:
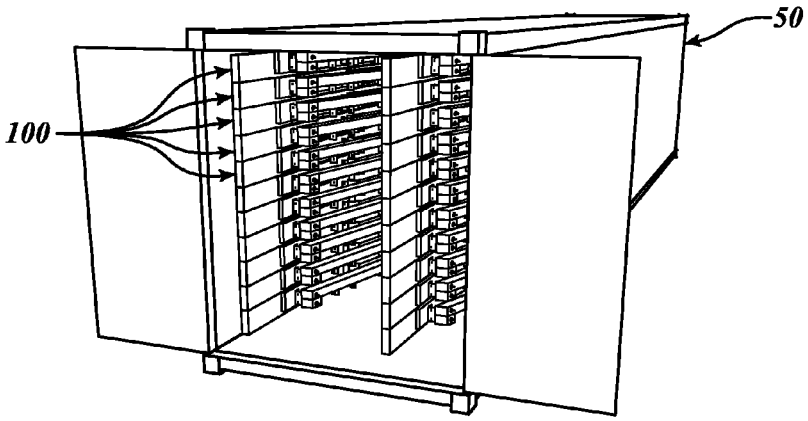
FIG. 2A is a pictorial view of a shipping container loaded with a plurality of folded frames from a plurality of collapsible dock systems, according to one embodiment.

The present disclosure relates to a dock system that includes a collapsible, preassembled frame that allows a greater number of dock systems to be shipped in a single shipping container when compared to the configuration illustrated in FIG. 1. For example, FIG. 2A illustrates a plurality of pre-assembled dock frames 100 folded and loaded into a shipping container 50. In this example, multiple pre-assembled dock frames 100 can be loaded into a single shipping container. This can dramatically reduce shipping costs when compared with shipping conventional pre-assembled docks 10 shown in FIG. 1. Using pre-assembled dock frames 100 also allows the bulk of construction to take place in a fixed location with better access to building materials. This allows manufacturers to take advantage of quantities of scale and a smaller more highly trained work force.

Figure 2B:
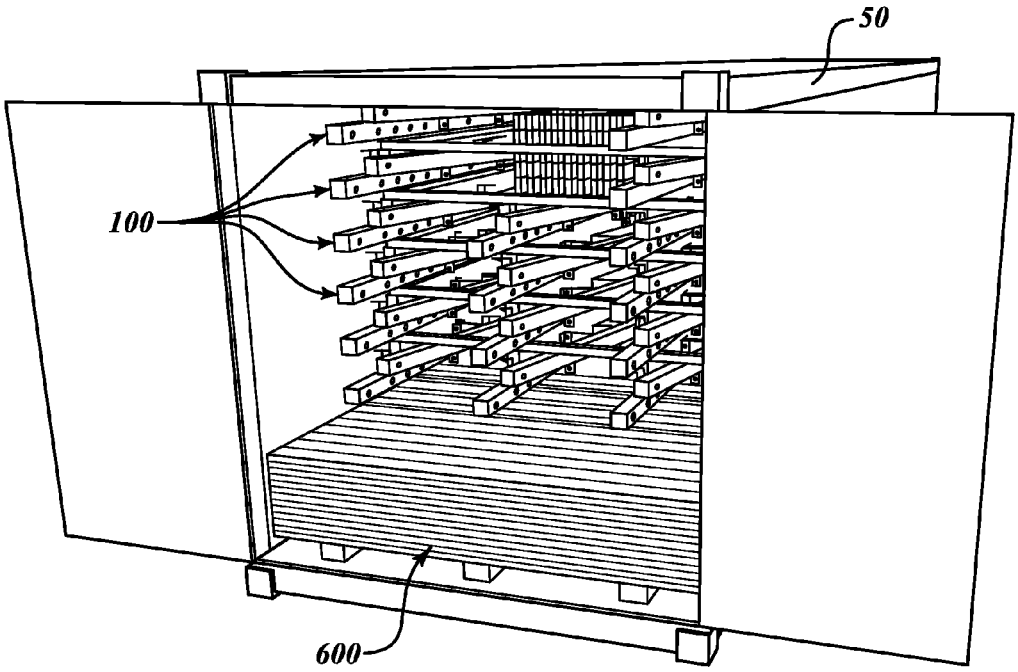
FIG. 2B is a pictorial view of a shipping container loaded with a plurality of folded frames and other component from a plurality of collapsible dock systems, according to one embodiment.

In another example, a complete dock assembly kit may be shipped in a single shipping container 50. For example, as shown in FIG. 2B, multiple frames 100, stringers, and deck boards 600 may all be shipped to an installation location in a single shipping container 50. Such a configuration may further decrease the amount of time required for assembly, because all of the necessary components arrive in a single compact container.

As will be discussed in greater detail below, the pre-assembled dock frames 100 are collapsible frames that are moveable from a collapsed state to an expanded state by way of a unique hinged bracket that allows the frames 100 to be collapsed for transport, and quickly expanded and assembled at an installation site. The hinged bracket includes a flat plate connected to an L-shaped bracket using a hinge arrangement or other arrangement to allow the flat plate to rotate relative to the L-shaped bracket. In this example, both the flat plate and the L-shaped bracket may include one or more drilled holes.

In one example, the first plate may be affixed to a long wooden beam using bolts through the one or more holes. Further, the L-shaped bracket may be affixed to a cross-member using bolts through the one or more holes on the section of the L-shaped bracket that is perpendicular to the first plate. While bolts are illustrated in the drawings and described herein, other appropriate connectors for attaching an item to wood can be used.

Figure 3:
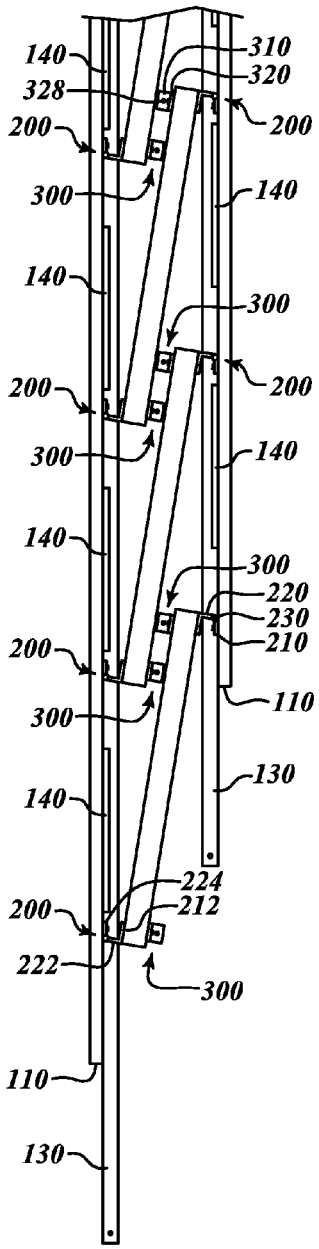
FIG. 3 is a top view of a frame of a collapsible dock system in a partially collapsed state, according to one embodiment.
Figure 4A:
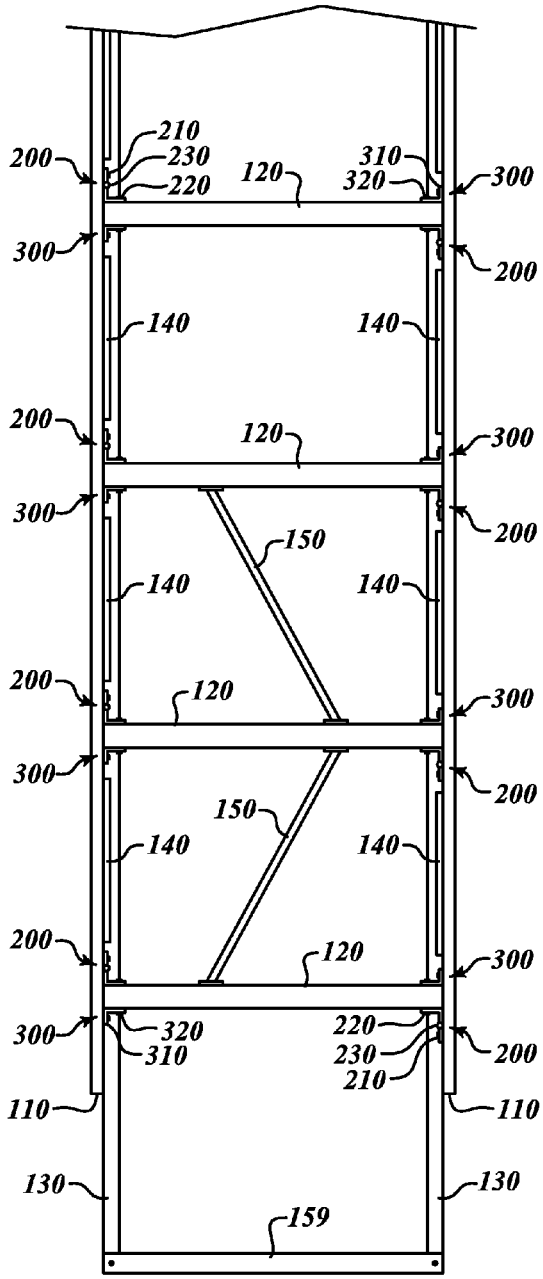
FIG. 4A is a top view of the frame in FIG. 3, in an expanded state, according to one embodiment.

Because the first plate and L-shaped bracket are connected by a hinge, the cross-beam can be folded relative to the beam as shown in FIGS. 3 and 4A. Because they can be folded, marina dock frames assembled according to the present disclosure take up less space in warehouses and during shipping. The order of assembly described above is not intended to be limiting. For example, the hinged bracket may be first affixed to the cross-member and then to the beam, or vice-versa.

In another example, a second hinged bracket may be mounted on the opposite end the cross-member. Further, in one example the first plate in the second hinged bracket may be affixed to a second beam. Thus, the two beams are connected via the cross-member in this embodiment. And because both beams are connected to the cross-member via a hinged bracket, the beams and cross-member can fold closer together, thus leading to easier shipping. Further, in such an example, a plurality of cross-beams may be connected to the two beams, using hinged brackets. Again, in examples where a plurality of cross-beams are connected to a beam with hinged brackets, the frame can be folded (see, e.g., FIG. 3) to improve shipping. For example, the marine dock component including at least two beams and a plurality of cross-beams can be folded for shipment to occupy a smaller volume than the component would occupy when the component is in its assembled state (e.g., the cross-beams are substantially perpendicular to the beams).

In one example, when the folded frame is unloaded at the marina where it is to be installed, the side of each L-shaped bracket that is not mounted to the cross-member may be affixed to the beam, for example, using one or more bolts through the pre-drilled hole (or holes) in the plate. Thus, one side of the L-shaped bracket is connected to the beam, and the other to the cross-member. Thus, the L-shaped bracket rigidly holds the cross-member in place against the beam. Further, in such an example, the beam and the cross-member may comprise pre-drilled holes through which large bolts or screws may be used to more securely fasten the cross-member to the beam. Further, diagonal beams may be added at various locations between the two beams, to make the frame more rigid.

In such an example, once the frame is assembled, floats are attached and the frame may be placed over water. At this point, beams of wood, often called stringers can be mounted to the cross-members, using for example thru bolts or lag screws. These stringers provide a platform to which decking may be mounted to create a walkway on the completed dock. Stringers can also divide the dock frame, providing a location to mount various utility cables or water or fuel hoses. For example, the spaces between stringers can provide a location to run utility cables carrying power of a first voltage separately from utility cables carrying power of a second voltage. A water line or other utility line can also be run in the space between stringers in some embodiments.

At this point, planks of wood, often called deck boards or decking, may be placed across the stringers or frame to provide a walking surface. Then, cleats may be added to the beams or cross-beams to provide a location to tie parking boats at the completed dock.

II. Collapsible Dock System

Figure 4B:
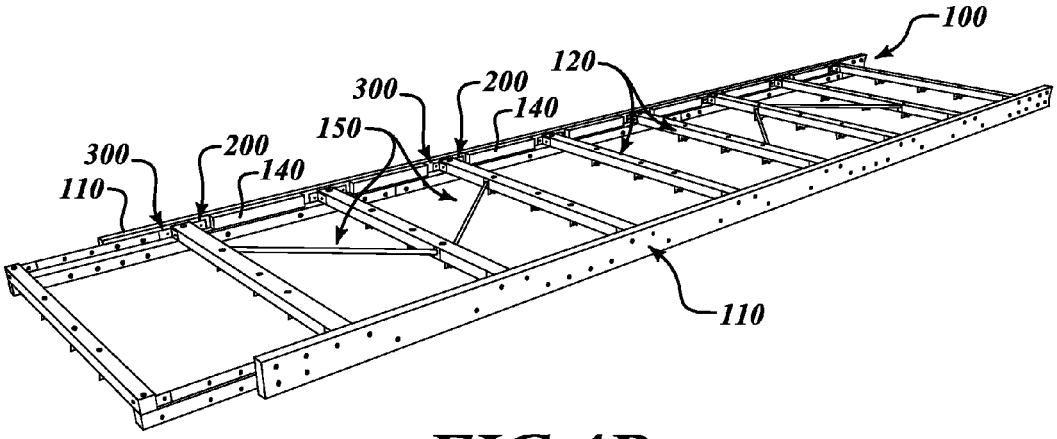
FIG. 4B is a pictorial view of the frame of FIG. 4A, in the expanded state.
Figure 4C:
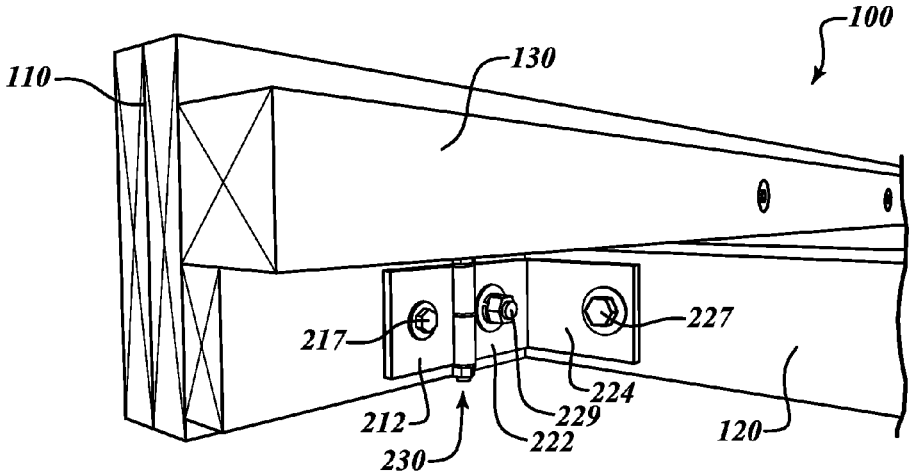
FIG. 4C is a pictorial view of a portion of the frame of FIG. 4A, in the expanded state.

Referring now to the drawings in which like numerals indicate like elements throughout the several figures, FIGS. 3 and 4A-4C illustrate a collapsible frame 100 of a dock system according to one example. FIG. 3 shows the frame 100 in a collapsed state that is ready for storage or transport. FIGS. 4A-4C show the frame 100 in an expanded state in which the frame 100 is ready for further assembly and installation at a work site.

The frame 100 includes two beams 110 and a plurality of cross-members 120 extending between the beams 110. Each of the cross-members 120 is coupled to the beams via a pair of hinged brackets 200. The pair of hinged brackets 200 are respectively coupled to a given cross-member 120 on opposite faces and opposite ends of the respective cross member 120.

Figure 5:
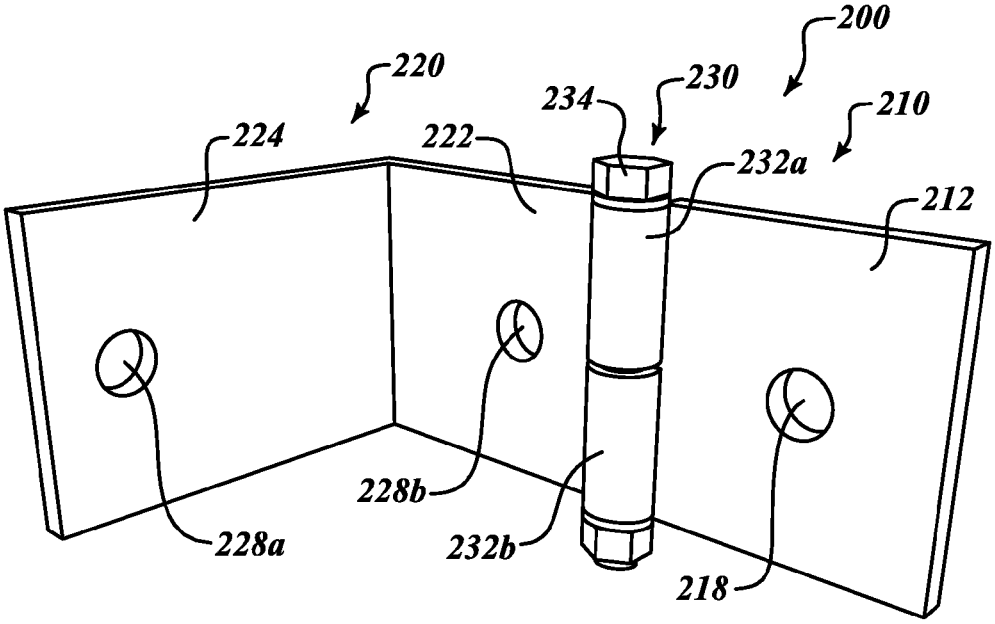
FIG. 5 is a pictorial view of a hinged bracket, according to one embodiment.

FIG. 5 illustrates an example hinged bracket 200 in greater detail. The hinged bracket 200 includes an L-shaped bracket 220 and a flat plate 210, which are connected to each other with a hinge 230.

The hinge 230 is configured to allow the L-shaped bracket 220 and the flat plate 210 to move relative to each other. In the example in FIG. 5, hinge 230 is a butt hinge that includes portion 232*a* fixed to portion 212 of plate 210, portion 232*b* fixed to portion 222 of L-shaped bracket 222, and pin 234. In other examples, other types of hinge may be used, such as a ball bearing hinge, a butterfly hinge, a double acting hinge, a flush hinge, or others. In some examples, hinge 230 may include metal, for example, stainless steel, galvanized steel, aluminum, or some other type of metal. In other examples, hinge 230 may include another material, for example, a plastic or composite material.

As noted above, in the example shown in FIG. 5, the hinged bracket 200 includes L-shaped bracket 220 and flat plate 210. In some examples, L-shaped bracket 220 may be larger or smaller by comparison to flat plate 210. For example, in some embodiments, L-shaped bracket 220 is a 4"×3" bracket. In such an example, flat plate 210 may be approximately 2¾" square. Further, in such an example, both the L-shaped bracket 220 and the flat plate 210 may be, for example, ¼" thick. In other examples, different sizes and thickness may be used.

In the example shown in FIG. 5, the L-shaped bracket 200 includes two flat plates 222 and 224 with edges intersecting at a substantially right angle. In some examples, both L-shaped bracket 220 and flat plate 210 may be metal, for example, stainless steel, galvanized steel, aluminum, or some other type of metal. In other examples, both L-shaped bracket 220 and flat plate 210 may be another material, for example, a plastic or composite material.

In the example shown in FIG. 5, L-shaped bracket 220 and flat plate 210 respective include holes 228*a*, 228*b*, and 218. Holes 228*a*, 228*b*, and 218 allow L-shaped bracket 220 and flat plate 210 to be mounted to beams 110 and cross-members 120 using bolts, screws, or other types of fasteners known in the art. In other examples, glues, epoxies, resins, clamps, clasps, clips, nails, pins, or anchors may be used to secure the hinged bracket 200 to the beams 110 and the cross-members 120. Holes 228*a*, 228*b*, and 218 may be pre-drilled or drilled on site. In some embodiments holes 228*a*, 228*b*, and 218 may include a pre-determined diameter, for example, 9/16". In other embodiments, holes 228*a*, 228*b*, and 218 may include a larger or smaller diameter, and each hole may be drilled to a different diameter.

In some embodiments (not shown in FIG. 5) the hinged bracket 200 may be a soft material. For example, in some examples, the hinged bracket 220 may be a piece of rubber, plastic, or leather, which is flexible enough to allow the frame 100 to be collapsed for shipping, but is strong enough to hold the beam 110 and cross-member 120 together for quick assembly. Such an example would require additional support to complete assembly of the frame, for example, bolts or wood screws through the beam into the cross-member.

FIG. 4C illustrates hinged bracket 200 mounted to a beam 110 and a cross-member 120, according to one example. In this example, the flat plate 212 of hinged bracket 200 is connected to beam 110 using a bolt 217. Further, the plate 222 of L-shaped bracket 220 of hinged bracket 200 is connected to the beam 110 using bolt 229, and the plate 224 of L-shaped bracket 220 of hinged bracket 200 is connected to the cross-member 120 using bolt 227. In this example, the hinged bracket 200 holds the cross-member 120 against the beam 110, preventing it from moving. When the bolt 229 on plate 222 of hinged bracket 200 is not installed, the hinge 230 in hinged bracket 200 allows cross-member 120 to fold relative to the beam 110, as shown in FIG. 3. This allows the assembled frame 100 to fold, making the frame 100 easier to ship. When the frame 100 is assembled at its installation site, the beam 110 may include pre-drilled holes corresponding to the hole 228*b* on plate 222 of hinged bracket 200 to facilitate easy installation.

In the example shown in FIGS. 4A-4C, beam 110 may be a 32 foot long 3"×10" beam. In other examples, beam 110 may be a different size or length depending on the size of the dock to be assembled, the shape of the dock, the location of the dock, the method of transporting the dock components to the installation site, and other factors. For example, in some examples, a 36 foot 4"×8" beam can be used. Further in the example shown in FIGS. 4A-4C, cross-member 120 can be a 6 foot long 4"×6" beam. In other examples, different lengths and sizes might be used again depending on a number of factors including, without limitation, the size of the dock to be assembled, the shape of the dock, the location of the dock, the method of transporting the dock components to the installation site, and other factors. For example, in other examples, the cross-member 120 can be an 8 foot long 4" by 4" beam. In some examples, the length of the beam 110 and cross-members 120 may be selected such that the folded dock fits in a shipping container, such as shipping container 50.

In the example shown in FIGS. 3 and 4A-4C, beam 110 further comprises a 4"×4" beam 130, which adds strength rigidity to beam 110. Beam 130 may be connected to beam 110 using bolts, woodscrews, or some other fastener known in the art. In some examples, beam 130 may be a different size. In other examples, beam 130 may not be included. The beam 110 also optionally may include members 140.

In the example shown in FIGS. 3 and 4A-4C, beams, 110, 120, and 130 are all wood. In some examples, this wood may be southern pine. In other embodiments, another type of wood may be used. In still other examples, the beams may be constructed out of a different building material, for example a metal such as galvanized steel, stainless steel, or aluminum. In still other embodiments, the beams may be a different building material for example, a plastic, polymer, or some type of composite material, for example a carbon-composite.

FIG. 3 illustrates a partially folded frame 100, according to one example of the present disclosure. As shown in FIG. 3, the folded dock frame 100 includes two beams 110, connected to each other via a plurality of cross-members 120. The cross-members 120 are connected to each beam 110 via a plurality of hinged brackets 200.

In the example shown in FIG. 3, one or more of the bolts 229 on the plate 222 of the L-shaped bracket 220 that could be attached to the beam 110, have not been attached. Thus, the hinges 230 in the hinged brackets 200 allow beams 110 and cross-members 120 to fold together, allowing for easier storage and shipping.

FIGS. 4A and 4B show an unfolded marina dock frame 100, according to one example. As shown in FIGS. 4A and 4B, the unfolded dock frame 100 includes two beams 110, connected to each other via a plurality of cross-members 120. The cross beams are connected to each beam via a plurality of hinged brackets 200.

FIGS. 4A-4C illustrate the frame 100 in an expanded state after all of the bolts in the hinged brackets 200 have been installed, thus holding beams 110 and cross-members 120 into a rigid frame. In some examples, beams 110 and cross-members 120 may further include predrilled holes, which can be used to bolt or screw the cross-members 120 to the beams 110 to increase the rigidity of the frame 100. In other embodiments, these holes may be drilled after the frame is assembled.

In the embodiment shown in FIGS. 4A and 4B, the frame 100 further includes diagonal braces 150, mounted between several of the cross-members 120. Diagonal braces 150 further increase the strength of the frame 100 in the expanded state. In other embodiments, diagonal braces 150 may be placed at different locations on the assembled frame 100. For example, diagonal braces 350 may be placed between the two beams 110. In the example shown in FIGS. 4A and 4B, the diagonal braces are comprised of galvanized steel. In other embodiments, they may comprise a different material, for example a metal such as stainless steel, aluminum, or some other type of metal. In other embodiments, diagonal braces 150 may be another material, for example, wood, a plastic, or composite material. In addition, as shown in FIG. 3A, an additional cross member 159 may be added for additional stability.

Figure 6:
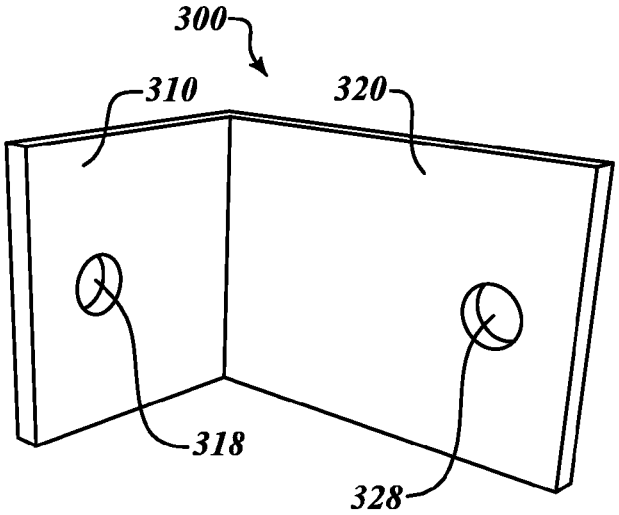
FIG. 6 is a pictorial view of an angle bracket, according to one embodiment.

In the example shown in FIGS. 4A and 4B, the cross-members 120 further include L-brackets 300 mounted using screws, bolts, or another known fastener on the opposite side of the cross-members 120 with respect to the hinged bracket 200. In this example, the L-shaped bracket 200 increases the strength of the mounting between the cross-members 120 and beams 110. FIG. 6 illustrates an L-shaped bracket 300 that includes two plates 310 and 320 that extend perpendicularly to each other and that respectively include through-holes 318 and 328.

As seen in FIG. 3, for example, one side of the L-shaped bracket 300 may be installed to either the beams 110 or the cross-members 120 before the assembled frame is unfolded. In this example, the bracket 300 is mounted to the cross-member 120, and rotated 90 degrees from its final installation orientation to allow the cross-members 120 to fold together without striking the brackets 300. For example, FIG. 3 shows a partially folded state in which the cross-members 120 and the beams 110 still are able to fold even closer together than depicted. The beams 110 or the cross-member 120 may include pre-drilled holes to ease installation of the remaining fasteners to the brackets 300 when the frame is unfolded. In other embodiments, the L-shaped bracket 300 may be installed after the frame is assembled.

Figure 7:
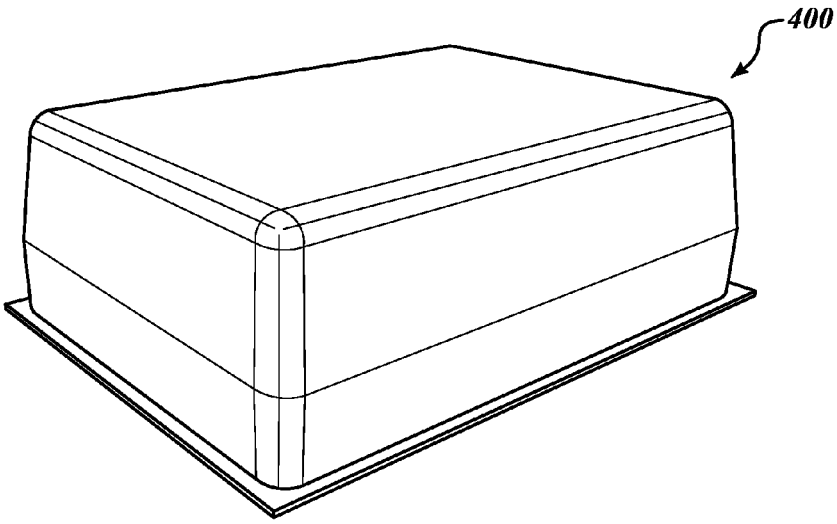
FIG. 7 is a pictorial view of a float member, according to one embodiment.

FIG. 7 shows a conventional float 400. In this example, the float 400 includes a plastic frame sealing a buoyant material, for example polystyrene. In other examples, the float may not include the plastic frame, and may be constructed of only polystyrene or similar buoyant material. Any number of floats known to those of skill in the art can be used in connection with marina docks of the present disclosure.

III. Method of Assembly

FIGS. 8A-8E illustrate the assembly of a dock system at an installation site.

Figure 8A:
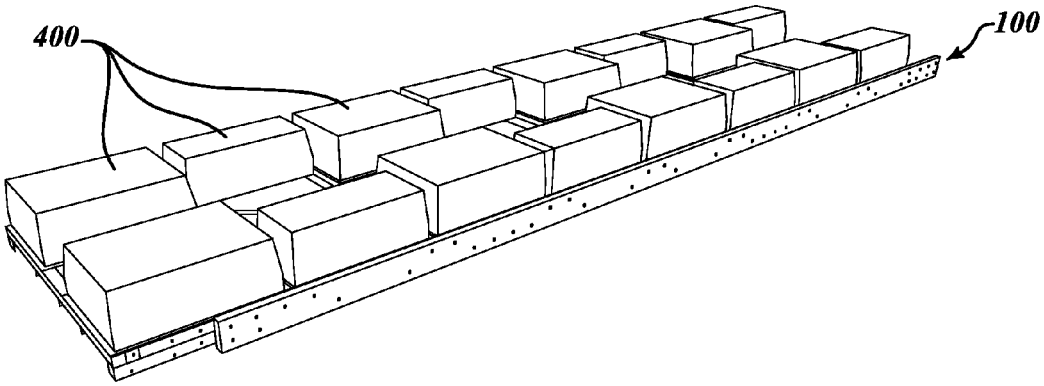
FIG. 8A is a bottom pictorial view of a plurality of float members assembled to a frame of a collapsible dock system.

FIG. 8A shows floats 400 mounted to the dock frame 100 in the expanded state. Floats 400 may be mounted to the frame 100 in a variety of ways known in the art, including, using bolts, screws, clamps, rope, glue, or some other mounting method known in the art. Once the floats 400 are mounted, the dock can be placed in the water or otherwise installed using techniques known to those of skill in the art.

Figure 8B:
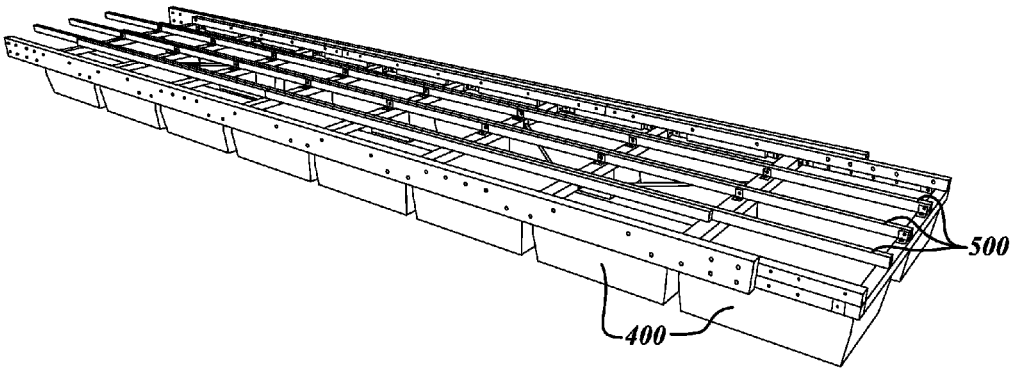
FIG. 8B is a top pictorial view of a plurality of stringers assembled to the collapsible dock system.

In FIG. 8B, the frame 100 with the floats 400 is flipped over, and stringers 500 are installed. Stringers 500 may be, for example, mechanically laminated 2"×4" boards that are attached to the 3"×3" brackets on cross-members using thru bolts, lag screws, or other fasteners known in the art. In heavier applications, the stringers may be 2"×6" boards. These stringers 500 provide a platform to which a decking 600 (shown in FIG. 8C) may be mounted in order to create a walkway on the completed dock module. The stringers 500 may be, for example, wood. In other examples, stringers 500 may be another material, for example, composite material, for example, a plastic or carbon based material. Stringers 500 also divide the dock frame 100, providing a location to mount various utility cables or water or fuel hoses. For example, stringers may provide a location to run utility cables carrying power of a first voltage separately from utility cables carrying power of a second voltage. In another embodiment, the stringers 500 may provide a bed to run fuel lines, for example, fuel lines to refuel docked boats, in a location separate from a bed for fresh water lines.

Figure 8C:
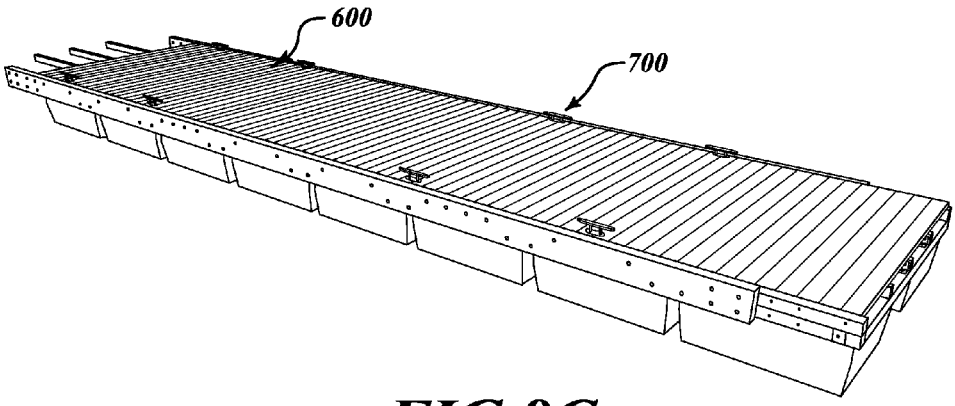
FIG. 8C is a top pictorial view of a decking and a plurality of cleats assembled to the collapsible dock system.

FIG. 8C shows a completed marina dock module according to one example. In this example, the dock module includes deck boards (or decking) 600, which create a deck on which people can walk. Deck boards (or decking) 600 can be placed in any configuration to create a deck on the surface of the dock. For example, deck boards (or decking) 600 may be mounted horizontally, vertically, diagonally, or in other configurations. In this example, deck boards (or decking) 600 are wood. In other embodiments, deck boards (or decking) 600 may be another material, for example, composite material, for example, a plastic or carbon based material.

The completed dock module in FIG. 8C further includes a plurality of cleats 700. Cleats 700 may be mounted to either the beams 110, cross-members 120, or deck boards (or decking) 600 on the completed dock module. Cleats 700 may be mounted using screws, bolts, nails, or some other type of fastener known in the art.

Figure 8D:
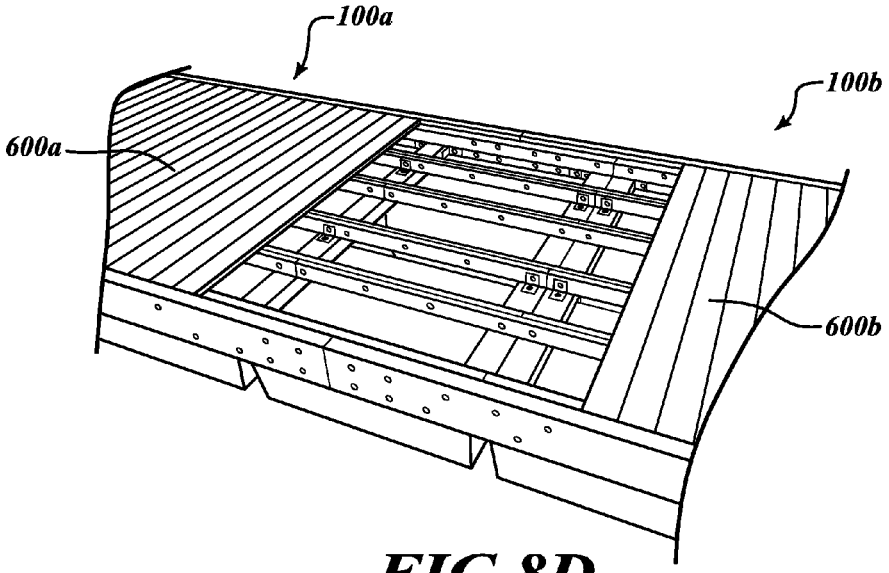
FIG. 8D is a top pictorial view of two, modular collapsible dock systems connected to each other, according to one embodiment.

Multiple dock modules may be assembled into a dock, as shown in FIG. 8D. In FIG. 8D, two dock modules are attached in a main to main connection. Main to main connections are created by overlapping the beams, stringers, or other components of two dock members. For example, as shown in FIG. 8D, dock module 100*a*, which includes decking 600*a*, is connected to dock module 100*b*, which includes decking 600*b*. For example, the connection between two dock modules may be made by connecting outside whalers on the male end of dock module 100*a* onto the female end of dock module 100*b*. In some embodiments, the connection may be reinforced by a heavy duty splice plate spanning the two connections with a plurality of thru bolts, or other fasteners, per splice plate. As shown in FIG. 8D, there are also male and female ends on the stringers that will interlock as the two dock modules come together and they are also connected using multiple thru bolts or other fasteners along each stringer 500. In some examples, four to six thru bolts also secure the connection where the cross beams come together for each dock module.

Figure 8E:
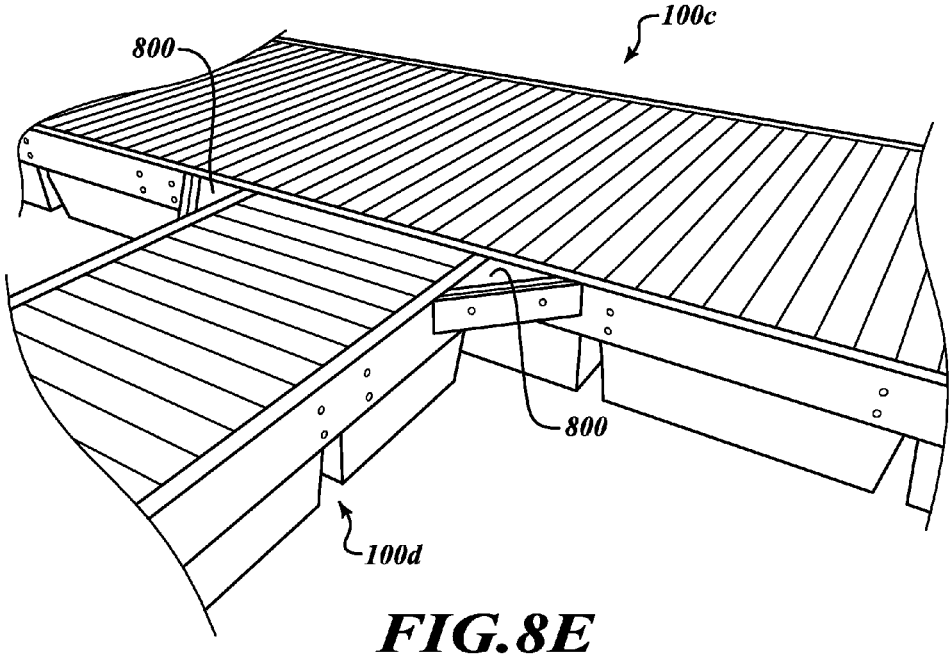
FIG. 8E is a top pictorial view of two, modular collapsible dock systems connected to each other, according to another embodiment.

In other examples, the dock modules may be combined to form a dock in a different configuration. For example, as shown in FIG. 8E, dock modules may be assembled in a finger to main connection. For example, dock modules 100*d* and 100*c* may be attached with two heavy duty steel gusset brackets 800 (one per side of each finger) with two thru bolts, or other fasteners, into the finger pier and two into the main dock per gusset. For example, two internal 3"×4" angle brackets can be attached to the finger framing and be thru bolted to the main dock module as well. In such an example, all thru bolts go through the outside whalers and 4"×4" torsion beam of the main dock.

As used herein the term module is generally used to describe components of a marina dock. However, in some examples, marina docks of varying size may comprise only a single marina dock module. In other examples, a plurality of marina dock modules may be used to assemble a complete marina dock.

Figure 9:
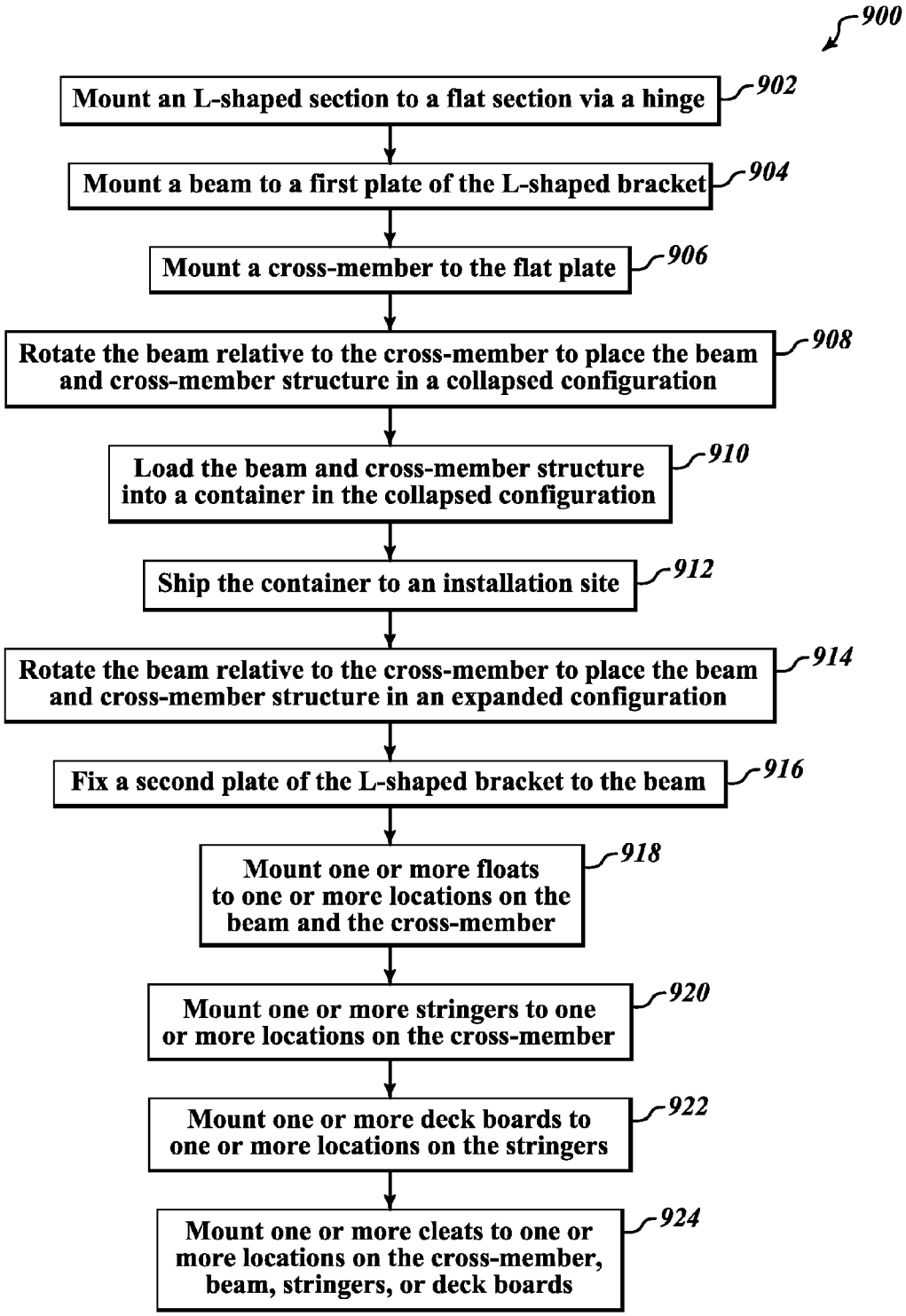
FIG. 9 is a flow chart of a method for assembling a collapsible dock system, according to one embodiment.

In addition to the methods previously described herein, FIG. 9 illustrates of a method 900 for assembling a marina dock module according to one example.

In this example, an L-Shaped bracket is first mounted to a flat plate using a hinge (step 902). The L-shaped bracket and the flat plate may each include one or more drilled holes. In some examples, the L-shaped bracket and the flat plate may be metal, for example, stainless steel, galvanized steel, aluminum, or some other type of metal. In other examples, the L-shaped bracket and the flat plate may be another material, for example, a plastic or composite material.

A beam is then mounted to the first plate of the L-shaped bracket, using screws, bolts, or other types of fasteners known in the art (step 904). The beam is mounted to the end of the L-shaped bracket to allow the other end to still articulate, perpendicularly to the beam. The beam may be, for example, a 32 foot long beam. A different length beam may be used, for example. The length of the beam may be selected to correspond to the length of a shipping container, to improve efficiency in the shipping process.

Next, a cross-member is mounted to the flat plate, using screws, bolts, or other types of fasteners known in the art (step 906). The cross-member can be mounted such that the hinge can fold the cross-member against the beam. the cross-member may be 6-feet in length, for example. In other examples, other lengths may be used depending on the desired width of the completed dock or other factors.

The order of steps 904 and 906 described above is not intended to be limiting. For example, in some embodiments, the hinged bracket may be first attached to the beam and then to the cross-member, or vice-versa. Further, in many embodiments, particularly embodiments with long beams, steps 904 and 906 are repeated to add multiple cross-members to a beam using hinged brackets. Further, a second beam may be attached to the opposite end of the cross-members using similar hinged brackets. Thus, such methods can be used to assemble a complete dock frame (or section of a dock) that can be folded.

In step 908, the beam is rotated relative to the cross-members to place the beam and cross-members in a collapsed configuration. In step 910, the beam and cross-member structure is loaded into a shipping container in the collapsed configuration. The process continues at step 912 when the folded frame can be shipped to an installation site. The folded frame may or may not be loaded into a container for shipping to an installation site, as shown in step 910. The length of the beam may be selected to correspond to the interior size of a shipping container, for example. Several dock frames can be folded and shipped side-by-side and/or stacked on top of another in the shipping container depending on the size of the container, the size of the frame, and other factors. Not all of the docks in the shipping container may be destined for the same location, for example. In one example, shown in FIG. 2B, all the components including the frame, floats, stringers, deck boards, and cleats may be shipped together in a single shipping container. In other examples, only some of the components needed for dock assembly may be shipped in the container. For example, all of the components, other than the floats, may be shipped together in a single container.

The shipping container may be a flat bed trailer, for example. In another example, the shipping container may be a stackable container, for example, a steel shipping container. In other examples, the shipping container may be a cardboard container, configured to ship a single frame. In some examples, the shipping container may be shipped on one or more of: a train, a boat, a truck, airplane, or other means of shipping known in the art.

In step 914, the beam is rotated relative to the cross-member to place the beam and cross-member structure in an expanded configuration. The second plate of the L-shaped bracket is ten mounted to the beam, using screws, bolts, or another type of fastener known in the art (step 916). At this point, the cross-member is fixed to the beam, such that the hinge prevents the cross-member from folding against the beam. The strength of the frame may then be increased, by installing bolts, or wood screws through the beam, into the cross-member. Diagonal braces may be mounted, using screws, bolts, nails, or another type of fastener known in the art to further increase the strength of the frame. In some examples, the diagonal braces may be mounted between the beams. In other examples, they may be mounted between the cross-members.

Next, at step 918, one or more floats are mounted to the one or more locations on the beam and the cross-member. The floats may be mounted in a variety of ways known in the art, including, using bolts, screws, clamps, rope, glue, or some other mounting method known in the art. Once the floats are mounted, the dock can be placed in the water using techniques known to those of skill in the art.

Next, one or more stringers can be mounted to one or more locations on the cross-members or the beams (step 920). The stringers may be mounted using, bolts, woodscrews, or other types of fasteners known in the art. The stringers may be wood, for example. In other examples, the stringers may be another material, for example, a plastic or composite material.

Then, one or more deck boards, sometimes referred to as decking, can be mounted to the stringers (step 922). The deck boards may be mounted using, bolts, woodscrews, or other types of fasteners known in the art. The deck boards may comprise wood, for example, or another material, such as a plastic or composite material.

One or more cleats can be mounted to one or more locations on the cross-member, beam, or stringer. The cleats are used to tie off parked boats, and may be mounted using screws, bolts, nails, or some other type of fastener known in the art (step 924).

Various potential advantages can be associated with various embodiments of marina docks and systems and methods for assembling marina docks, although each embodiment does not necessarily possess every potential advantage. First, some systems and methods for assembling marina docks can dramatically reduce the cost of shipping a dock. This reduction in cost can make it possible to manufacture the bulk of the dock at a single location and/or to ship it more efficiently. In some embodiments, the manufacturing location can be set up to handle larger volumes, to utilize cheaper raw materials, to ship to a greater concentration of installation locations, or for other reasons.

As another example, some embodiments of the present invention can reduce the time needed to assemble a dock.

Because in some embodiments a dock frame can be fully constructed prior to delivery at an installation site, less labor may be required and/or the labor needed may not need to be as skilled in the field of dock construction. This can reduce the overall cost for installing a dock, and can also lead to less downtime in the event that a dock owner needs to replace a section of its dock.

IV. General Observations

The skilled artisan will recognize the interchangeability of various features from different embodiments disclosed herein. Similarly, the various features and acts discussed above, as well as other known equivalents for each such feature or act, can be mixed and matched by one of ordinary skill in this art to perform methods in accordance with principles described herein. Additionally, the methods which are described and illustrated herein are not limited to the exact sequence of acts described, nor are they necessarily limited to the practice of all of the acts set forth. Other sequences of events or acts, or less than all of the events, or simultaneous occurrence of the events, may be utilized in practicing the embodiments of the invention.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, it is not intended that the invention be limited, except as by the appended claims.

What is claimed is:

1. A collapsible frame docking system, comprising:

a first beam; a first cross-member; and a first hinged bracket that selectively secures the first beam to the first cross-member in either a first collapsible state in which the first cross-member is rotatable relative to the beam and a first expanded state in which the first cross-member is fixed relative to the beam; wherein the first hinged bracket includes an L-shaped bracket portion including a first plate extending in a first direction from a first end of the hinged bracket to a junction portion of the L-shaped bracket portion, wherein the first plate is fixedly secured to the cross-member in both the collapsible state and the expanded state, a second plate extending in a second direction, substantially perpendicular to the first direction, from the junction portion of the L-shaped bracket portion to a hinge portion of the L-shaped bracket portion, wherein the first and second plates are fixed relative to each other in both the collapsible state and the expanded state, the second plate is not fixed relative to the beam in the collapsible state, and the second plate is fixedly secured to the beam in the expanded state; a third plate that is fixedly secured to the beam in both the collapsible state and the expanded state; and a hinge that rotatably secures the third plate to the second plate such that, in the collapsible state, the cross-member is rotatable relative to the beam.

2. The collapsible frame of claim 1, wherein, when the first beam is secured in the expanded state, the collapsible frame is configured to receive a plurality of floats on a first side thereof, and a decking surface on a second side thereof.

3. The collapsible frame of claim 1, further comprising:

a second beam; and a second hinged bracket that selectively secures the second beam to the first cross-member in either a second collapsible state in which the first cross-member is rotatable relative to the second beam or a second expanded state in which the first cross-member is fixed relative to the second beam.

4. The collapsible frame of claim 3, wherein the first hinged bracket and the second hinged bracket are respectively fixed to the cross-member on opposite faces and opposite ends of the first cross-member.

5. A collapsible dock system, comprising:

a collapsible frame including a first beam; a second beam; a cross-member system that secures the first beam to the second beam; and a hinged bracket system that is selectively coupled to the first beam and the second beam in either a compact transport state in which the first beam is movable relative to the second beam or a fixed installation state in which the first beam is fixed relative to the second beam; wherein the at least one hinged bracket includes an L-shaped bracket portion including a first plate extending in a first direction from a first end of the hinged bracket to a junction portion of the L-shaped bracket portion, wherein the first plate is fixedly secured to the respective cross-member in both the compact transport and the fixed installation state, a second plate extending in a second direction, substantially perpendicular to the first direction, from the junction portion of the L-shaped bracket portion to a hinge portion of the L-shaped bracket portion, wherein the first and second plates are fixed relative to each other in both the compact transport state and the fixed installation state, the second plate is not fixed relative to the beam in the compact transport state, and the second plate is fixedly secured to the beam in the fixed installation state; a third plate that is fixedly secured to the beam in both the compact transport state and the fixed installation state; and a hinge that rotatably secures the third plate to the second plate such that, in the compact transport state, the cross-member is rotatable relative to the beam.

6. The collapsible dock system according to claim 5, further comprising a plurality of floats secured to a first side of the collapsible frame.

7. The collapsible dock system according to claim 6, further comprising a plurality of stringers secured to a second side of the collapsible frame that is opposite to the first side of the collapsible frame.

8. The collapsible dock system according to claim 7, further comprising a deck surface secured to the plurality of stringers.

9. The collapsible dock system of claim 5, wherein the cross-member system includes a plurality of cross-members that extend between the first beam and the second beam, and the hinged bracket system includes, for each cross-member, at least one hinged bracket coupled to the respective cross member and one of the first beam and the second beam.

10. The collapsible dock system of claim 9, wherein the at least one hinged bracket is a pair of hinged brackets, and one of the pair of hinged brackets is coupled to the first beam and the respective cross-member, and the other of the pair of hinged brackets is coupled to the second beam and the respective cross-member.

11. The collapsible dock system of claim 10, wherein the pair of hinged brackets are respectively fixed to the respective cross-member on opposite faces and opposite ends of the respective cross-member.

12. A method for assembling a dock, comprising:

unfolding a pre-assembled frame;

locking the preassembled frame in a rigid configuration;

securing a plurality of floats to first side of the preassembled frame; and securing a decking surface to a second side, opposite the first side, of the preassembled frame.

13. The method of assembling the dock of claim 12, wherein unfolding the pre-assembled frame includes moving a first beam away from a second beam, the first and second beam being coupled to each other by a plurality of cross-members.

14. The method of assembling the dock of claim 13, wherein the preassembled frame includes a hinged bracket system, the hinged bracket system includes, for each cross-member, at least one hinged bracket coupled to the respective cross member and one of the first beam and the second beam, and locking the pre-assembled frame in the rigid configuration includes securing a portion of the at least one hinged bracket to the one of the first beam and the second beam.

15. The method of assembling the dock of claim 14, wherein the at least one hinged bracket is a pair of hinged brackets, and locking the pre-assembled frame in the rigid configuration includes securing a portion of one of the pair of hinged brackets to the first beam and securing a portion of the other of the pair of hinged brackets to the second beam.

16. A collapsible frame docking system, comprising:

a first beam; a first cross-member; a first hinged bracket that selectively secures the first beam to the first cross-member in either a first collapsible state in which the first cross-member is rotatable relative to the first beam and a first expanded state in which the first cross-member is fixed relative to the first beam, the rotation being in a first direction about a first hinged bracket axis; a second beam; and a second hinged bracket that selectively secures the second beam to the first cross-member in either a second collapsible state in which the first cross-member is rotatable relative to the second beam and a second expanded state in which the first cross-member is fixed relative to the second beam, the rotation being in a second direction opposite the first direction and about a second hinged bracket axis.

* * * * *